US009394129B2

(12) United States Patent
Hara et al.

(10) Patent No.: US 9,394,129 B2
(45) Date of Patent: Jul. 19, 2016

(54) PRINTING MACHINE AND FEEDING METHOD FOR PRINTING MACHINES

(75) Inventors: Masashi Hara, Ibabaki-ken (JP); Tatsunori Kaneko, Ibaraki-ken (JP); Hitoshi Arai, Ibaraki-ken (JP); Ryota Yamagishi, Ibaraki-ken (JP)

(73) Assignee: RISKO KAGAKU CORPORATION, Tokyo (JP)

( * ) Notice: Subject to any disclaimer, the term of this patent is extended or adjusted under 35 U.S.C. 154(b) by 183 days.

(21) Appl. No.: 12/659,651

(22) Filed: Mar. 16, 2010

(65) Prior Publication Data

US 2010/0237557 A1 Sep. 23, 2010

(30) Foreign Application Priority Data

Mar. 18, 2009 (JP) ..... P2009-066362
Mar. 18, 2009 (JP) ..... P2009-066445
Mar. 18, 2009 (JP) ..... P2009-066480

(51) Int. Cl.

| | |
|---|---|
| ***B65H 5/00*** | (2006.01) |
| ***B65H 5/26*** | (2006.01) |
| ***B65H 5/38*** | (2006.01) |
| ***B65H 7/00*** | (2006.01) |
| ***B65H 9/00*** | (2006.01) |

(52) U.S. Cl.

CPC .. *B65H 5/26* (2013.01); *B65H 5/38* (2013.01); *B65H 7/00* (2013.01); *B65H 9/006* (2013.01); *B65H 2511/414* (2013.01); *B65H 2513/50* (2013.01); *B65H 2557/23* (2013.01)

(58) Field of Classification Search

CPC ..... B65H 5/26; B65H 5/38; B65H 7/00; B65H 9/006; B65H 2513/50; B65H 2557/23; B65H 2511/414

USPC ..... 271/270

See application file for complete search history.

(56) References Cited

U.S. PATENT DOCUMENTS

| | | | | |
|---|---|---|---|---|
| 4,629,172 | A * | 12/1986 | Kameyama et al. | 271/9.13 |
| 5,543,909 | A * | 8/1996 | Quesnel | 399/394 |
| 5,933,697 | A * | 8/1999 | Onodera et al. | 399/406 |
| 6,062,556 | A * | 5/2000 | McCay | 271/9.13 |
| 6,298,778 | B1 * | 10/2001 | Onodera et al. | 101/232 |
| 7,237,772 | B2 * | 7/2007 | Kamamura | 271/9.01 |
| 2002/0063384 | A1 * | 5/2002 | Quesnel | 271/270 |

(Continued)

FOREIGN PATENT DOCUMENTS

| | | | |
|---|---|---|---|
| JP | 5-294520 | A | 11/1993 |
| JP | 2000-108481 | A | 4/2000 |

(Continued)

OTHER PUBLICATIONS

Official Action, issued on Feb. 19, 2013 in the counterpart Japanese application, in Japanese, two (2) pages.

(Continued)

*Primary Examiner* — Howard Sanders

(74) *Attorney, Agent, or Firm* — Greenblum & Bernstein, P.L.C.

(57) ABSTRACT

Configuration with paired register rollers cooperative with a downstream head unit on a circulation route to register a print sheet, a feed route extending up to the register rollers, and feeder elements controllable for a downstream feed of print sheet along part of the feed route to the register rollers, the feeder elements being controllable for a change of feed speed or acceleration in accordance with information on a back tension of a print sheet on the circulation route.

5 Claims, 14 Drawing Sheets

(56) References Cited

U.S. PATENT DOCUMENTS

| | | | | |
|---|---|---|---|---|
| 2004/0164484 | A1* | 8/2004 | Mizuno | 271/270 |
| 2007/0040325 | A1* | 2/2007 | Matsumoto et al. | 271/186 |
| 2008/0211177 | A1* | 9/2008 | Obuchi et al. | 271/265.01 |
| 2008/0232880 | A1* | 9/2008 | Noguchi et al. | 399/397 |
| 2009/0057996 | A1* | 3/2009 | Matsushima | 271/270 |
| 2009/0178961 | A1* | 7/2009 | Saimei | 209/552 |
| 2009/0302531 | A1* | 12/2009 | Katogi et al. | 271/270 |

FOREIGN PATENT DOCUMENTS

| | | | |
|---|---|---|---|
| JP | 2000-108482 | A | 4/2000 |
| JP | 2002-167075 | A | 6/2002 |
| JP | 2005-67802 | A | 3/2005 |
| JP | 2008-137757 | A | 6/2008 |
| JP | 2009-46303 | A | 3/2009 |

OTHER PUBLICATIONS

Official Action, issued on Feb. 26, 2013 in the counterpart Japanese application, in Japanese, two (2) pages.

Official Action, Decision of Refusal, Japanese Application No. 2009-066480, issued on Nov. 5, 2013, one (1) page.

* cited by examiner

PRINTING MACHINE AND FEEDING METHOD FOR PRINTING MACHINES

BACKGROUND OF THE INVENTION

1. Field of the Invention

The present invention relates to a printing machine including an image forming unit adapted for formation of images on a recording medium in course of transfer on a transfer route, and a feeding method for printing machines.

2. Description of Related Arts

In the field of image forming devices including those of an inkjet system, there have been recent trends of diversification in, among other specifications, size and type of print sheets, accompanied by provision of a system of feed routes adapted for a sheet feed complying with any specification for print sheet to be used. Image forming devices generally have a mechanism configured with a set of rolls arranged in a transverse and/or normal opposing relation (referred herein to as a roller) installed for register on a transfer route, upstream of an image forming unit, to temporarily hold a print sheet as a recording medium fed from any feed mute, giving a slack, to thereby adjust a timing to send out the print sheet to set on the transfer route.

Each print sheet is transferred to the image forming unit, under a control consistent with an associated transfer condition that varies depending on the combination of a set of sheet specifications such as size and type of sheet and a set of route conditions such as curvature and distance of travel. If the register roller had a greater transfer speed than an upstream roller, there might have been a print sheet being retained by the upstream roller when pulled by the register roller, with a so-called back tension (by tensile forces acting) on the print sheet, which would have constituted a cause to generate noises upon removal of a slack produced by the register roller such as for adjustment of the timing to send out the print sheet, as an issue.

Such the back tension might also have constituted causes of a delay in transfer timing, a deviation of image position, and a jamming of sheet, involving an affect of the delay in transfer timing constituting an obstacle against image formation at higher processing rates, as another issue.

To avoid such issues, there has been a feed system disclosed in Japanese Patent Application Laid-open Publication No. 2002-167075 (referred herein to as a patent document 1), including a feeder configuration having a pair of feed rollers for gripping a print sheet to send out, and a drive mechanism for spacing feed rollers off from each other as necessary to release the print sheet from the gripping, for cancellation of back tensions.

There has been another feed system disclosed in Japanese Patent Application Laid-open Publication No. 2000-108482 (referred herein to as a patent document 2), including an assist roller installed upstream of a register roller on a transfer route, to assist the register roller transfer any specified type of print sheet at a transfer speed corresponding to the sheet type, to prevent the print sheet from failing to slack.

SUMMARY OF THE INVENTION

According to a technique disclosed in the patent document 1, each feed roller pair has needed provision of a drive mechanism for spacing feed rollers off from each other, thus leading to an enlarged, complicate system with an increased cost in production, as an issue.

Further, to attend to the demand for an enhanced print production, there has been a recent trend to implement a printing process with a promoted speedup, needing a feed route for a massive amount of print sheets to be fed at high speeds. For a register roller adapted to slack a print sheet for timing adjustment, the transfer speed has been subject to sudden accelerations and sudden decelerations for frequent starts and stops. However, for the configuration including an assist roller with inertia or such, it has been difficult to be speedy to attain a target transfer speed. The patent document 2 has disclosed techniques for simple control of a speed-variable assist roller. This would have been unable to follow up register roller's sudden accelerations and sudden decelerations, and might have suffered from elimination of a slack in course of acceleration, or formation of an excessive slack. Thus, even with techniques disclosed in the patent document 2, the configuration with an adapted register roller has been subject to, among others, a sudden un-slacking or over-slacking upon acceleration or deceleration, failing to control the noise.

The present invention has been devised in view of such issues. Accordingly, it is an object of the present invention to provide a printing machine including an image forming unit with a system of feed routes, and a feeding method for such printing machines, allowing for an eliminated complexity in configuration, and prevented occurrences of transfer noise due to a back tension.

To achieve the object described, according to an aspect of the present invention, there is a printing machine comprising an image forming unit adapted for formation of images on a recording medium in course of transfer on a transfer route, a register installed upstream of the image forming unit on the transfer route and adapted for adjustment of a timing to send a recording medium to the image forming unit, a feeder set adapted for feed of a recording medium to the register, a feed route system adapted for connection of feed mute through the feeder set to the register, and an assist controller configured to change an acceleration of the feeder set in assistance by the resistor in accordance with information on a tension of a recording medium in the feed mute system.

According to another aspect of the present invention, there is a feeding method for printing machines including an image forming unit adapted for formation of images on a recording medium in course of transfer on a transfer mute, a register installed upstream of the image forming unit on the transfer route and adapted for adjustment of a timing to send a recording medium to the image forming unit, a feeder set adapted for feed of a recording medium to the register, and a feed route system adapted for connection of feed mute through the feeder set to the register, the feeding method comprising changing an acceleration of the feeder set in assistance by the resistor in accordance with information on a tension of a recording medium in the feed route system.

DETAILED DESCRIPTION OF PREFERRED EMBODIMENTS

Outline of Printing Machine

Figure 1:
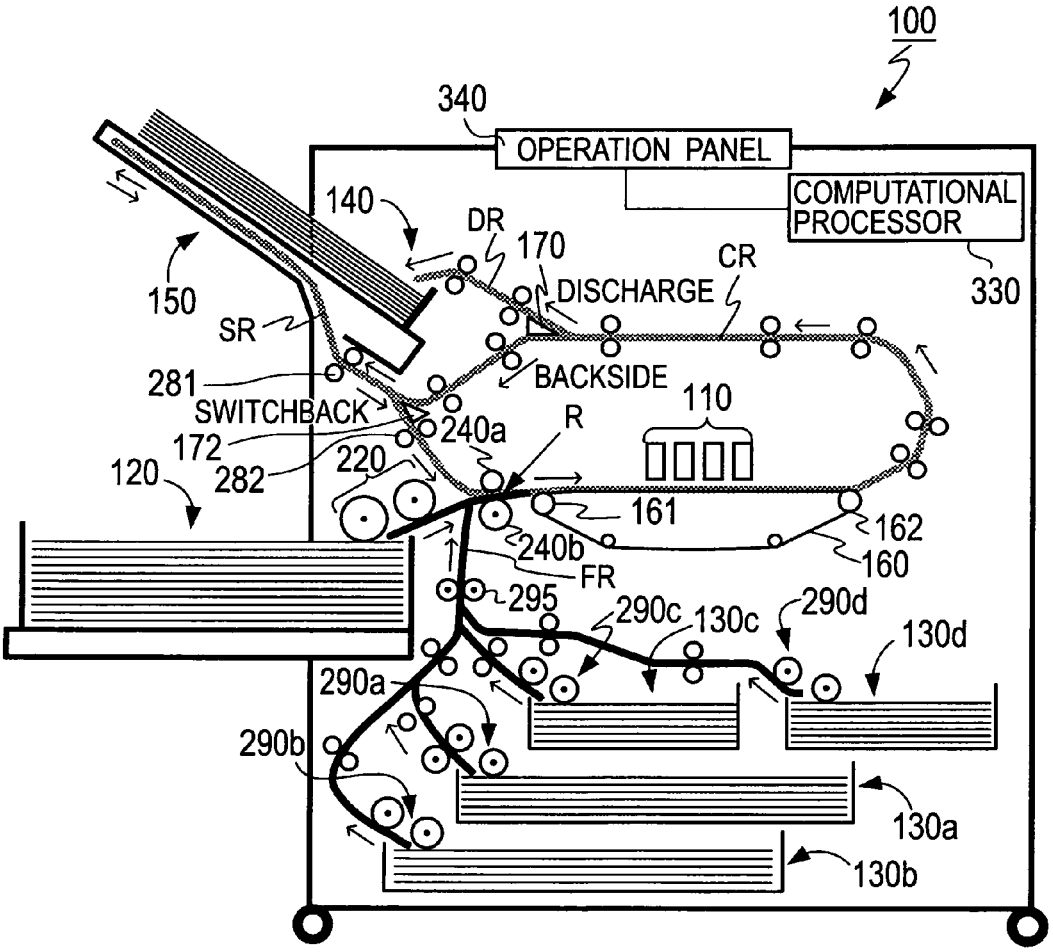
FIG. 1 is a schematic diagram illustrating a printing machine with a system of print sheet transfer mutes according to an embodiment of the present invention.
Figure 2A:
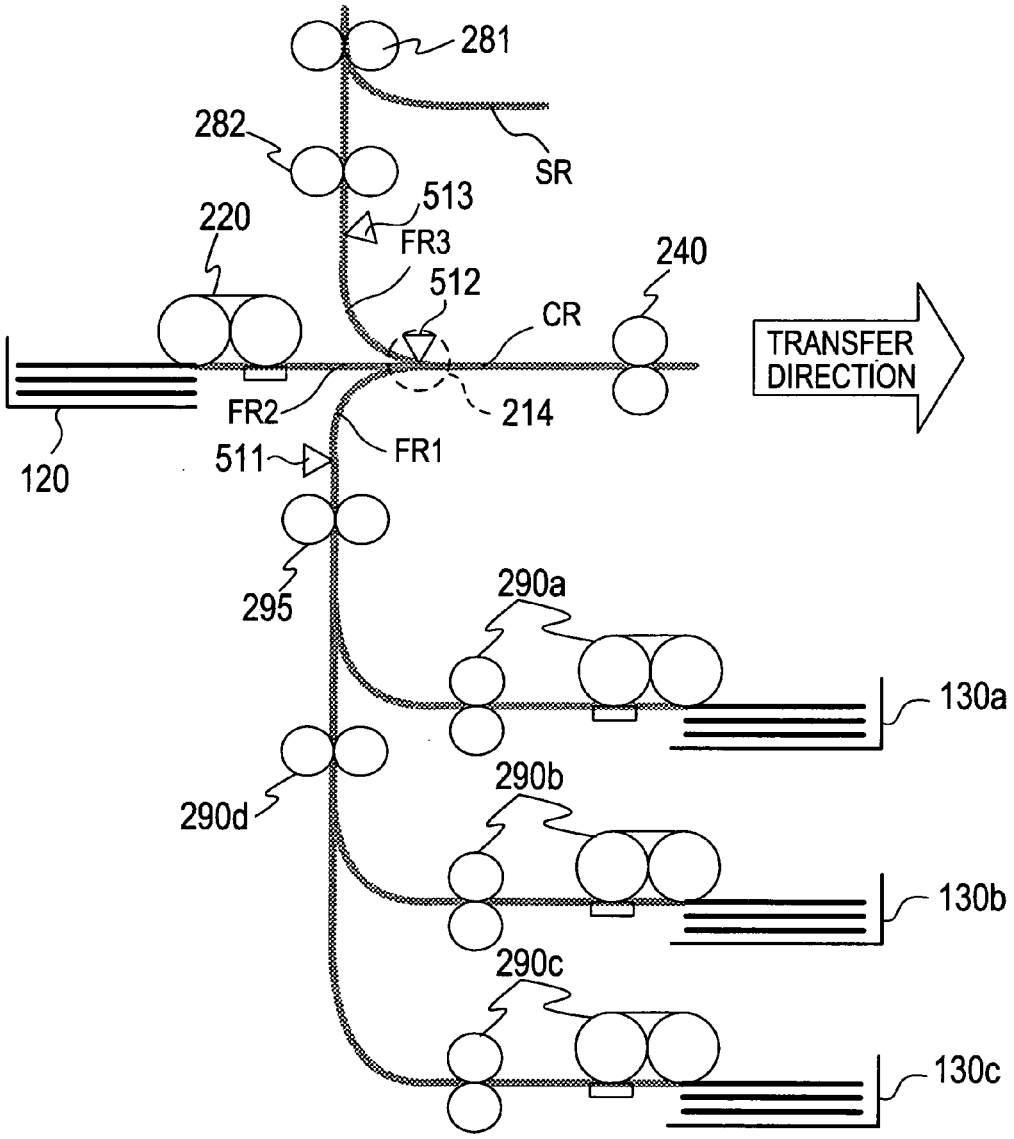
FIG. 2A is a pattern diagram of the transfer mute system including a feed mute system, a circulation route, and a switchback route according to the embodiment, and FIG. 2B, a detailed pattern diagram of part of the transfer route system.
Figure 2B:
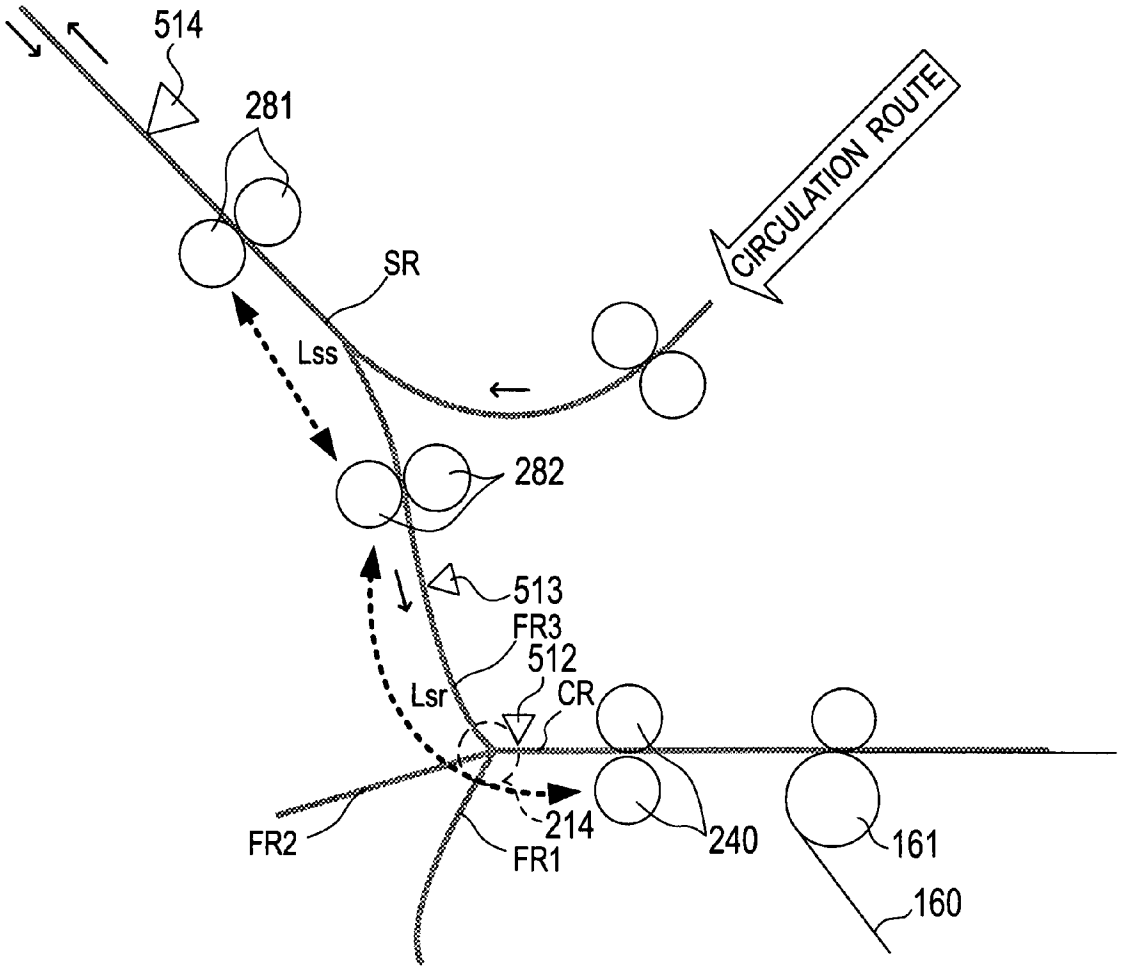

There will be described an embodiment of the present invention with reference to the drawings. FIG. 1 shows in a schematic diagram an illustration of a printing machine 100 provided with a system of print sheet transfer mutes according to the embodiment of the present invention. FIG. 2A and FIG. 2B show, in pattern diagrams, essential portions of the transfer route system that respectively include a feed route system FR, a circulation route CR for duplex printing (partially lapping over FR), and a switchback mute SR (lapping over CR). Associated drives are configured with rollers, which are depicted as necessary for comprehension.

According to the embodiment, the printing machine 100 includes, as a line color printer of an inkjet system, a head unit 110 being composed of an array of ink heads each formed with a multiplicity of nozzles for propelling therefrom droplets of a black or chromatic color ink to make a print by lines, whereby images are formed in a superposing manner on a print sheet as a recording medium on a transfer belt.

Referring to FIG. 1, the printing machine 100 is implemented as an apparatus including the above-noted unit for forming images on a front side or back side of a print sheet in course of a travel along part of the circulation route CR as a looped series of transfer routes in the transfer route system. The transfer route system includes: the feed route system FR being configured to feed a sheet; a normal route for single-side printing that extends from a junction with the feed route system FR, passing under the head unit 110, reaching a junction with a discharge route DR and the switchback route SR being connected to the normal route. The circulation route CR for duplex printing is composed of the normal mute for single-side printing, the switchback route SR, and part of the feed route system FR.

The feed route system FR has a specific number of feed mechanisms each configured to feed a print sheet. One of them is implemented as a side feed tray 120 arranged outside a lateral face of a machine housing, the rest being implemented as internal feed trays 130*a*, 130*b*, 130*c*, and 130*d* (designated herein collectively by 130) installed inside the machine housing. The discharge route DR is configured as a discharge mechanism with a discharge port 140 to discharge a printed sheet guided thereto.

The feed mute system FR extends inside the machine housing, and a print sheet picked up thereto from either the side feed tray 120 or any internal feed tray 130 is transferred therealong by drives, such as rollers, to a resister R that provides a reference position to a leading edge of print sheet. The register R has a register roller, there being rollers installed upstream thereof, which are controllable as drives for actions (assist actions) to feed a print sheet as a recording medium.

On the other hand, downstream of the register R, there is arranged the head unit 110 composed of arrayed print heads. The head unit 110 is disposed to confront an upside of a transfer belt 160, whereon a print sheet is fed to transfer at a prescribed speed in accordance with given printing conditions, whereon ink droplets are propelled from the print heads to form images by lines.

There is a print sheet thus printed, which is further transferred by drives such as rollers along the circulation route CR. After a single-side printing in which a print is made simply on one side of a print sheet, this sheet is directly guided through the discharge route DR to the discharge port 140, where it is discharged to stack, with the printed side down, on a stacker 150 provided as a receiving tray at the discharge port 140. The stacker 150 is configured in the form of a tray protruding from the machine housing, with a necessary thickness. The stacker 150 is inclined, and has a stopper formed as a wall at a lower end of inclination, where print sheets discharged from the discharge port 140 are end-trimmed in due course to provide a defined stack.

For a duplex printing in which both sides of a print sheet are to be printed, (assuming "a front side" as one side being anterior to print, and "a back side" as the other side being posterior to print), the print sheet as printed on the front side is not guided to the discharge route DR, but still transferred inside the machine housing, to send to the switchback route SR. Between the discharge route DR and the switchback route SR, there is a junction to branch off, where the circulation route CR has a selector 170 configured for a change-over to select a route for a printing on the back side. After any selection by the selector 170 to avoid sending out a print sheet to the discharge route DR, this sheet is pulled into the switchback route SR.

In the switchback route SR, there is a print sheet thus received from the normal route, which sheet undergoes a so-called switchback, where it is reciprocally moved forth and back in a reversing manner to put on the route with the front side down and the back side up. This sheet is yet transferred by drives such as rollers, via another selector 172, and through a feed route FR3, to return to the normal route, whereby it is re-fed to the register R, to provide for a printing to be performed on the back side in a similar manner to the printing on the front side. After that, the back side is printed, so the print sheet has images formed on both sides, which sheet is to be guided through the discharge route DR to the discharge port 140, where it will be discharged to stack on the stacker 150 provided as a receiving tray at the discharge port 140.

It is noted that in this embodiment the stacker 150 has a space defined therein to be available for a switchback operation in the duplex printing. This space is provided inside the stacker 150, and the enclosure is adapted as a structure to keep a print sheet safe against an external removal during the switchback operation.

In the printing machine 100, the register R constitutes a reference position to a leading edge of a fed print sheet, where also a print sheet as printed on one side is re-fed in duplex printing. Hence, the circulation route CR has, in part thereof just before the register R, a route junction 214 at which a feed route adapted for feed of a fresh print sheet meets "a route section adapted for re-feed of a print sheet being circulated for a printing on the back side" (referred herein to as a re-feed route, or simply as a feed route). This junction 214 constitutes a junction between the circulation route CR and the feed route system FR, of which downstream the register R is installed and adapted to send out a print sheet as described.

Further, in this embodiment, once a print sheet is fed, the print sheet is not always printed and discharged before the next feed of print sheet, but controlled for a travel consistent with a given schedule in which, before discharging a preceding print sheet, a subsequent print sheet may be fed to implement a consecutive printing at preset intervals. In a typical schedule for duplex printing, for instance, there is preservation of an empty space or sheet interval to be secured, when a sheet is fed for a printing on the front side, to permit insertion of a sheet returned via the switchback route SR. This allows for the printing machine to execute front side printing and back side printing in a paralleled manner, with a secured one-half print production relative to single-side printing.

The transfer belt 160 is applied over a drive roller 162 and a driven roller 161 disposed at front and rear ends of an upside facing the head unit 110, and is controlled to rotate clockwise in FIG. 1. The head unit 110 is arranged to look the upside of transfer belt 160, and configured with four color ink heads arrayed in the direction of belt movement, to form superimposed color images on a print sheet.

Referring to FIG. 1, the printing machine 100 includes a computational processor 330. This processor 330 is configured as an operation module composed of a processor such as a CPU (central processing unit) or DSP (digital signal processor), memory, other hardware elements such as electronic circuits, and/or software elements such as those having similar functions, and adapted for execution of programs read as necessary to build up superstructures of various functional modules, enabling use of built modules to implement processing image data and user instructions, controlling actions of components, etc. The computational processor 330 is interfaced with an operation panel 340, to acquire therefrom information on user instructions and settings.

(Feeder Set)

Figure 3:
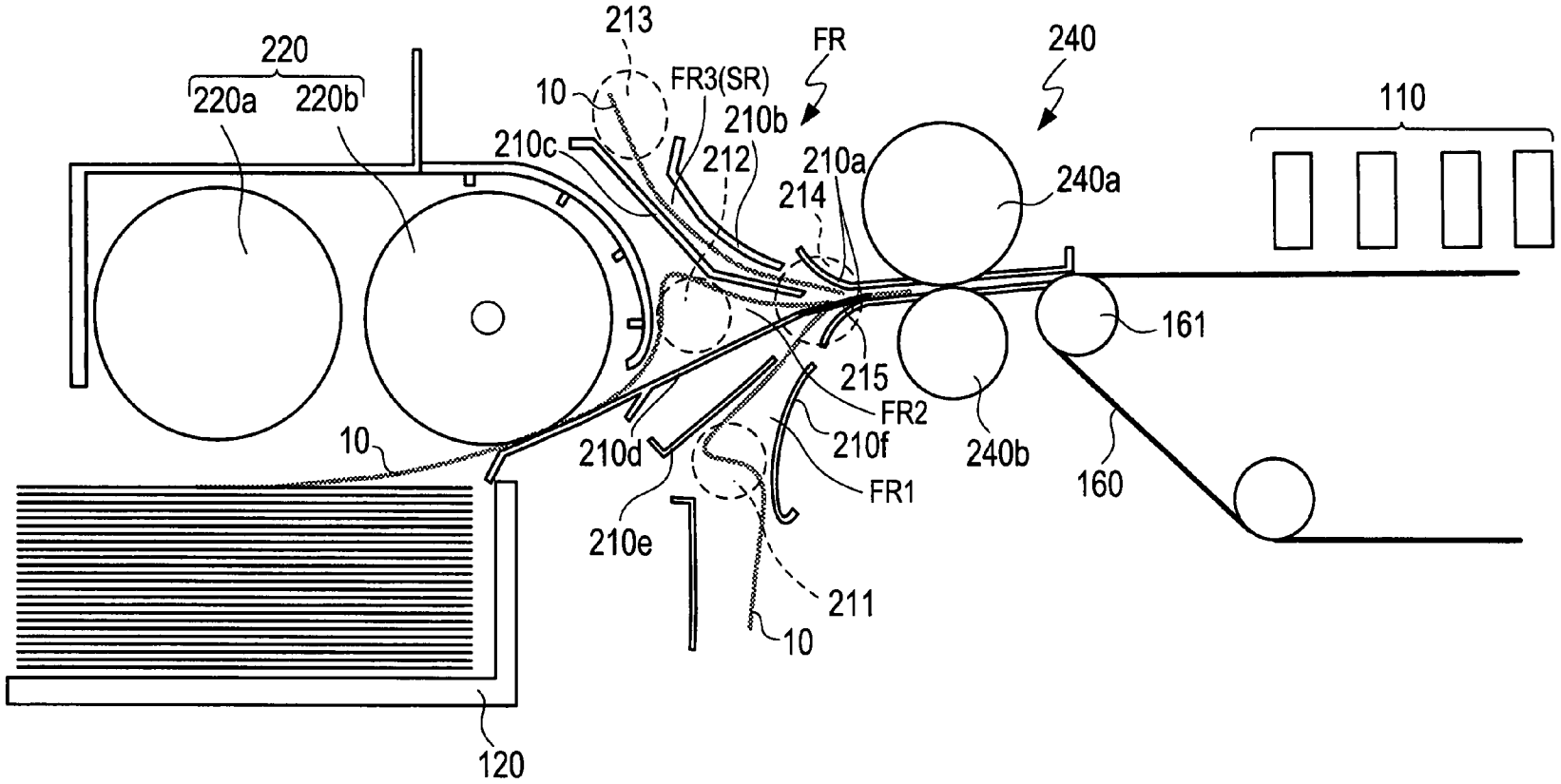
FIG. 3 is a detailed side view about a junction of a feed mechanism according to the embodiment.

According to the present embodiment, the feed route system FR has a feeder set in terms of a set of feeders or feeding means each composed of a sequence of mechanical drive elements or a subsequence thereof, such as a roller, that constitutes an associated feed route or part thereof. FIG. 3 is a detailed side view of an essential portion of the feeder set covering a route junction.

This figure shows a subset of the feeder set as a disperse system of feed mechanisms incorporated in the feed route system FR and adapted for cooperation under drive control to feed a print sheet to the register R. In this embodiment, the feed route system FR includes: a first feed route subsystem FR1 composed of trunk and branch feed routes adapted for cooperation under drive control as necessary to feed a fresh sheet from any one of the internal feed trays 130 (130*a*, 130*b*, 130*c*, and 130*d*) installed in a lower section of the machine housing; a second feed route subsystem FR2 composed of a single feed route adapted to work under drive control to feed a fresh sheet from the side feed tray 120; and a third feed route subsystem FR3 composed of a circulation route section adapted to work under drive control as the feed route for a re-feed from the switchback route SR. The first subsystem FR1 and the second subsystem FR2 meet the third subsystem FR3 at the junction 214, so any fed sheet from any of them travels through the junction 214 to come up to the register R.

The register R has a register drive 240 installed on the circulation route CR, upstream of the head unit 110. The register drive 240 includes a pair of upper and lower register rollers 240*a* and 240*b* (referred herein sometimes collectively to as a register roller 240) adapted to temporarily register any print sheet fed thereto from the feed route system FR, for adjustment of a timing to send out the print sheet to the head unit 110.

The junction 214 includes upper and lower paired guide members 210*a* and 210*b* shaped to define in between a confluent route tapered downstream to extend to and beyond the register R. The first to third feed route subsystems FR1 to FR3 have their downstream ends arranged to join together at the junction 214. The subsystems FR1, FR2, and FR3 have their diverge portions 211, 212, and 213 each located upstream the junction 214, for slacking a feeding print sheet.

More specifically, in the first feed route subsystem FR1, the trunk feed route is configured at a downstream end thereof with paired guide members 210*e* and 210*f*, which are shaped to define in between a feed route end tapered downstream toward the junction 214, to feed an upwardly incoming print sheet upward. The guide members 210*e* and 210*f* are diverged upstream downwardly to provide the diverge portion 211. The trunk feed route has an intermediate transfer roller 295 installed upstream of the diverge portion 211. The intermediate transfer roller 295 is controlled to keep feeding a print sheet downstream, as far as this is engaged therewith, so in due course the print sheet being fed has its leading edge brought into engagement with the register roller 240, where it is registered for adjustment of a timing to send out, as well as for alignment correction, causing the sheet to slack in part at the diverge portion 211. The trunk feed route is branched upstream of the intermediate transfer roller 295 into four branch feed routes, which have their sets of feed rollers 290*a*, 290*b*, 290*c*, . . . (referred herein each collectively to as a feed roller set 290). At each branch feed route, the feed roller set 290 is controllable to feed a corresponding kind of print sheet downstream, to a position where the intermediate transfer roller 295 is engageable therewith.

In the second feed route subsystem FR2, the single feed route has at a downstream end thereof paired guide members 210*c* and 210*d*, which are shaped to define in between a feed route end tapered downstream toward the junction 214, to feed an incoming print sheet obliquely upward. The guide members 210*c* and 210*d* are diverged upstream to provide the diverge portion 212. The single feed route has a set of primary feed rollers 220*a* and 220*b* (referred herein collectively to as a primary feed roller set 220) installed upstream of the diverge portion 212, to pick up a print sheet from the side feed tray 120. The primary feed roller set 220 is controlled to keep feeding a print sheet downstream, as far as this is engaged therewith, so in due course the print sheet being fed has its leading edge brought into engagement with the register roller 240, where it is registered, causing the sheet to slack in part at the diverge portion 212. It is noted that in this embodiment the single feed route has a route length between the side feed tray 120 and the register roller 240, which is smaller than the size of a regular sheet (e.g. A4 or A3) specified for the tray 120.

In the third feed route subsystem FR3, the two-way (circulation and re-feed) adapted feed route has at a downstream end thereof paired guide members 210*b* and 210*c* (the latter being common to FR2), which are shaped to define in between a feed route end tapered downstream toward the junction 214, to feed an incoming print sheet obliquely downward. The guide members 210*b* and 210*c* are diverged upstream obliquely upwardly to provide the diverge portion 213. The two-way adapted feed route has a subset of the feeder set installed upstream of the diverge portion 213, to re-feed a reversed print sheet in the switchback route SR to the register R. The feeder subset is controlled to keep feeding a print sheet downstream, as far as this is engaged therewith, so in due course the print sheet being fed has its leading edge brought into engagement with the register roller 240, where it is registered, causing the sheet to slack in part at the diverge portion 213. The feeder subset includes a switchback roller 281 and a re-feed roller 282. The switchback route SR has a (sheet-end detecting) sheet sensor 514 for detecting a print sheet having passed the switchback roller 281, and the two-way adapted feed route has a (sheet-end detecting) sheet sensor 513 for detecting a print sheet having passed the re-feed roller 282.

The junction 214 has a guide member 215 configured for restriction of sheet transfer at downstream ends of the feed route subsystems FR1 to FR3, to make a confluence between feed route subsystems FR3 and FR2 upstream of a confluence between feed route subsystems FR2 and FR1 within a prescribed region of the junction. More specifically, the guide member 215 is made as a flexible resin sheet of plastic, acryl, or such, and applied in the manner of extending a downstream end of the guide member 210*d* separating the feed route subsystems FR1 and FR2 from each other, so that the confluence between the feed route subsystems FR1 and FR2 comes most downstream.

In the second feed route subsystem FR2, the side feed tray 120 has a stack of print sheets accommodated therein, of which a top print sheet is picked up by the primary feed roller 220. The primary feed roller 220 is configured as a combination of upstream pickup roller 220*a* and downstream pickup roller 220*b* controlled for rotation to drive the top print sheet to feed to the register R.

(Transfer Control System)

Figure 4:
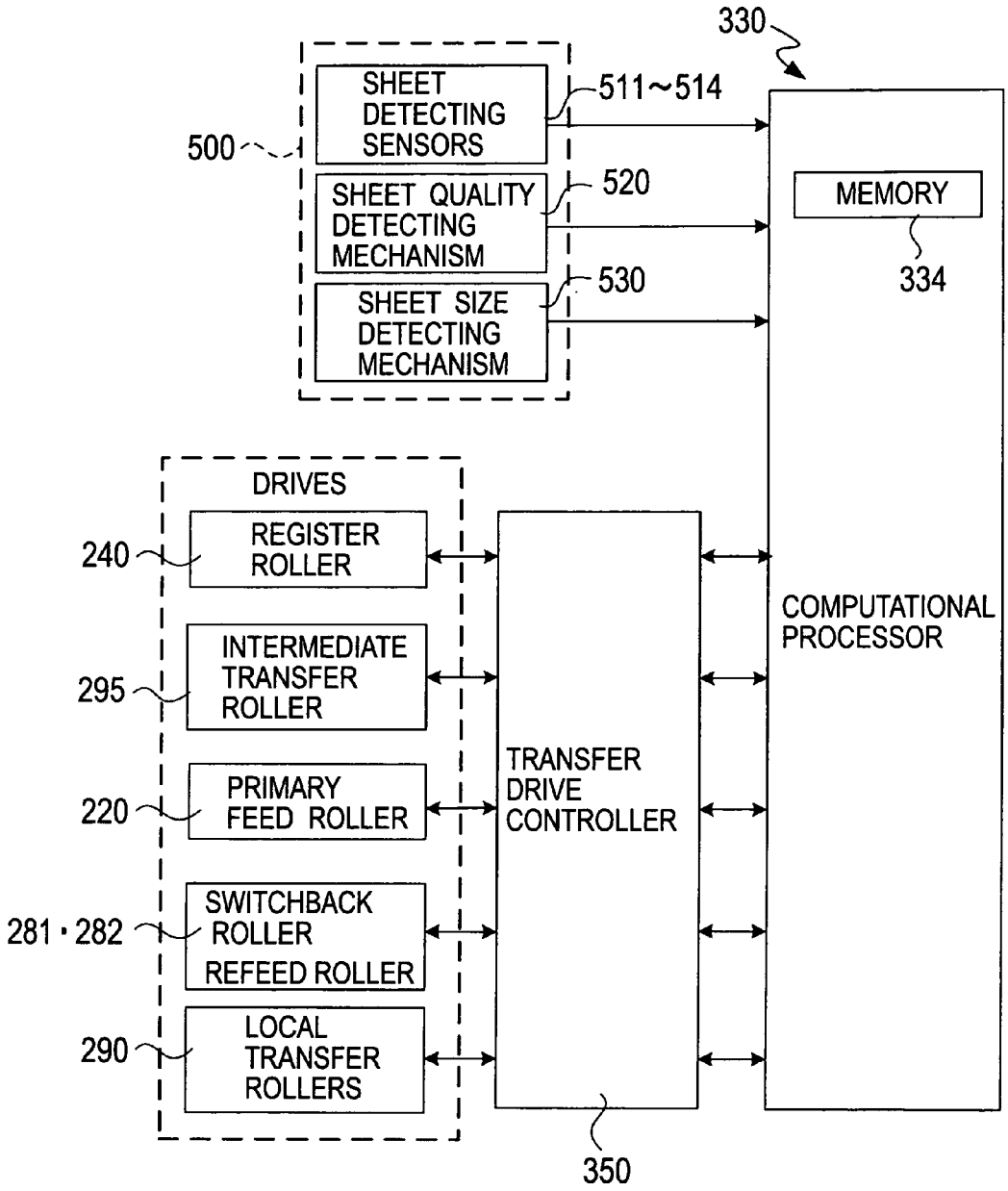
FIG. 4 is a block diagram of modules addressed to transfer control at a computational processor and in peripheries thereof according to the embodiment.
Figure 5:
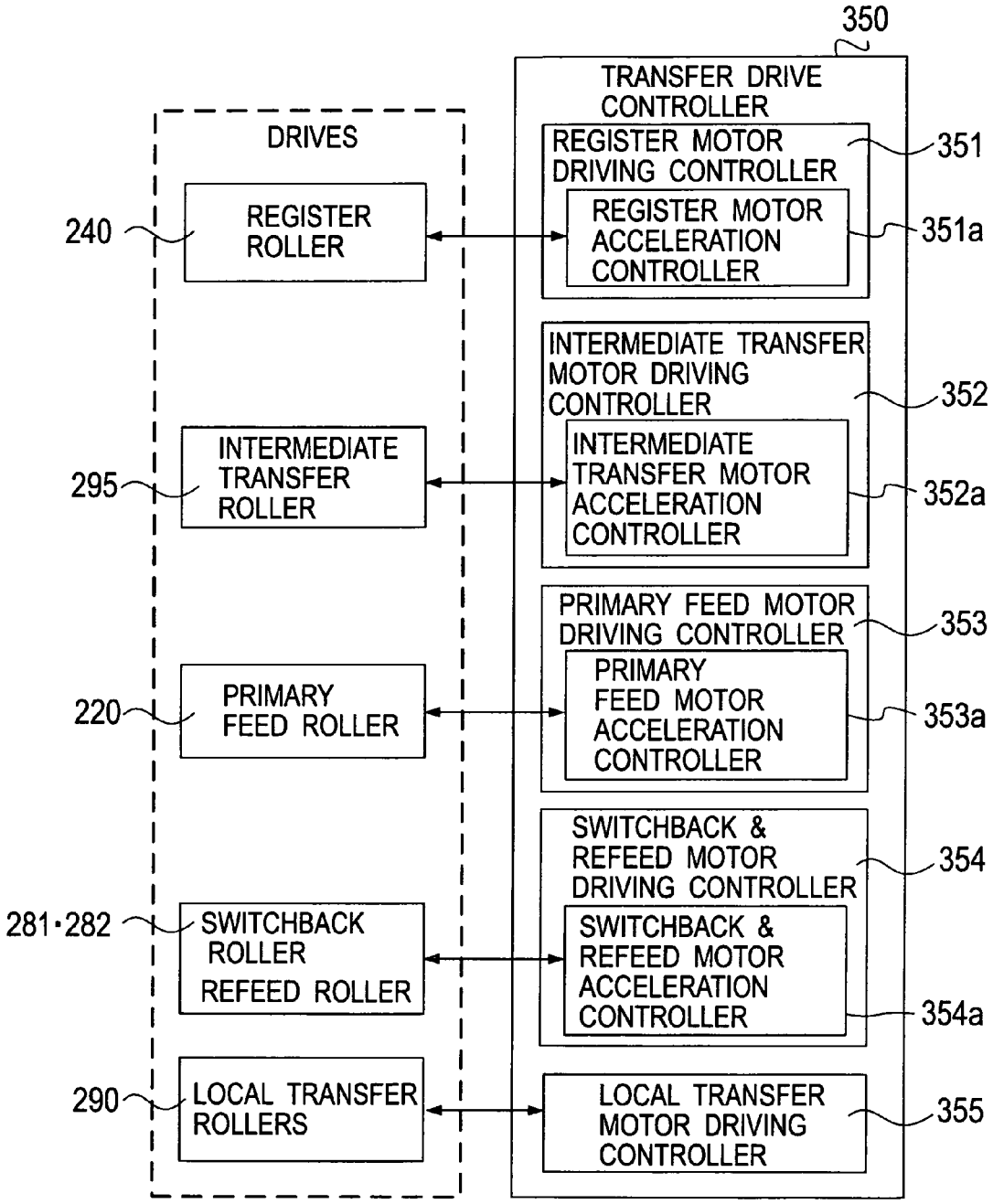
FIG. 5 is a block diagram of modules addressed to transfer control at a transfer drive controller and in peripheries thereof according to the embodiment.
Figure 6:
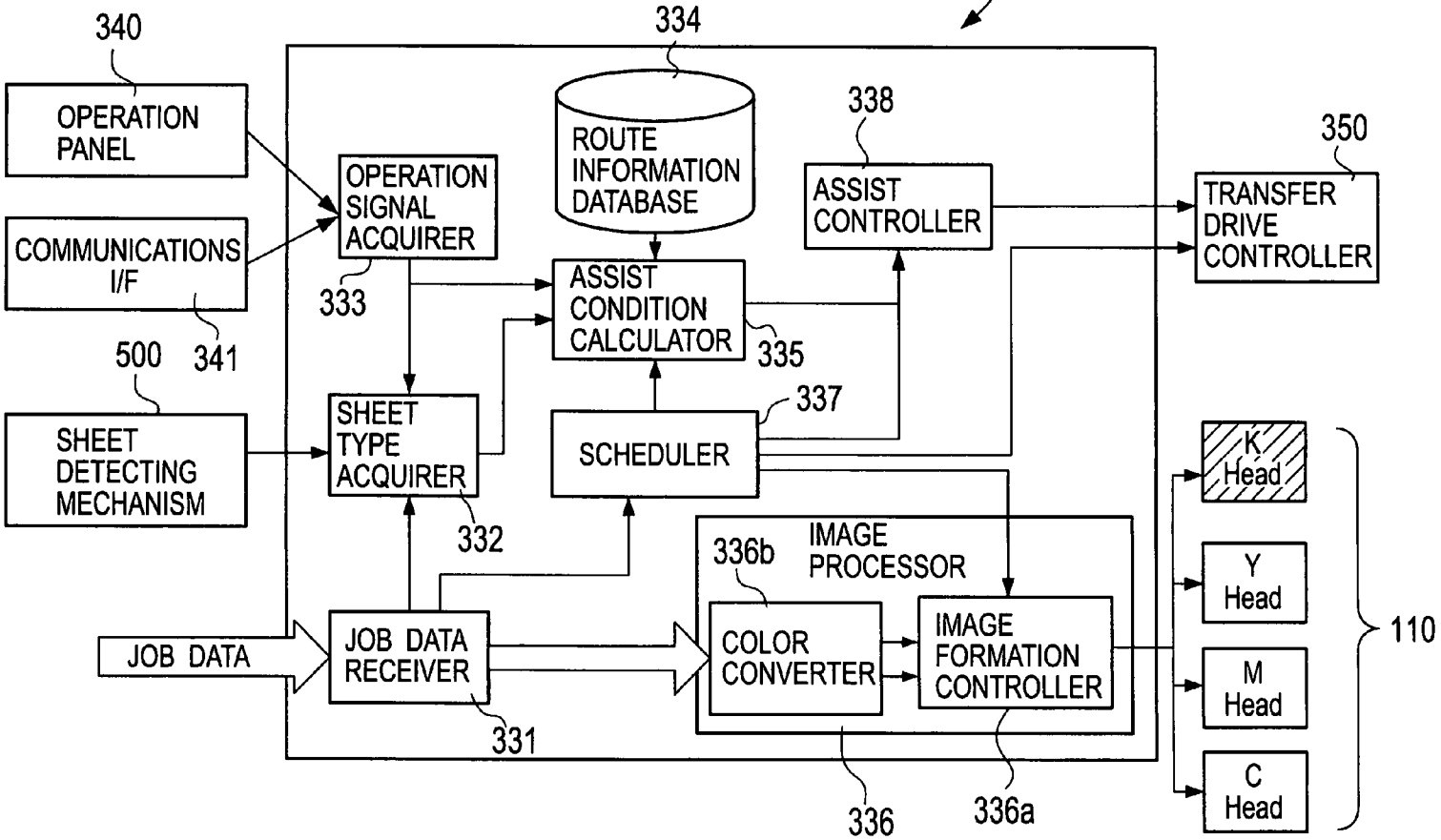
FIG. 6 is a block diagram of modules addressed to transfer control at the computational processor according to the embodiment.

Transfer routes described are each subject to a transfer drive control implemented by the computational processor 330. FIG. 4, FIG. 5, and FIG. 6 show, in block diagrams, sets of modules addressed to processes for transfer control at the computational processor 330 and peripheries thereof. As used herein the term "module" means a complex of hardware elements such as devices and appliances, or software elements programmed to implement their functions, or any combination in between configured as a functional unit to fulfill a specified performance or performances.

FIG. 4 shows a transfer control system according to the present embodiment including the computational processor 330, a set of modules for sheet detection 500, and a transfer drive controller 350 for controlling drives.

(1) Sheet Detection Module Set

The sheet detection module set 500 is configured as set of modules to acquire pieces of information on a print sheet or print sheets having been, being, or to be transferred, including a necessary number of kinds of sheet sensors 511 to 514, a sheet quality detecting mechanism 520, and a sheet size detecting mechanism 530.

FIG. 2A and FIG. 2B show several sheet sensors 511 to 514 distributed to the feed route subsystems FR1 to FR3 and the switchback route SR. They are adapted as necessary to detect presence (if passing) or absence (if having passed) of a concerned print sheet 10 in way of feed, or detect a size, type, and/or a thickness of the print sheet. There are sets of detection data transmitted to the computational processor 330. In this embodiment, sheet sensors used may be any type available such as a reflective sensor or a transmission sensor.

The sheet quality detecting mechanism 520 is implemented as a module to acquire a type or types of a sheet or sheets to be transferred in the feed route system FR. The sheet quality detecting mechanism 520 is adapted to read data of, among others, user's sheet setting at a printer driver or on the operation panel 340, and setting of a feed pressure setup lever and transmissivity at each associated sensor in the printing machine 100, for acquisition of a type or types of a sheet or sheets to be targeted in an associated transfer process, to transmit thus acquired sheet type data to the computational processor 330.

The sheet size detecting mechanism 530 is implemented as a module to acquire a size or sizes of a sheet or sheets to be transferred in the feed route system FR. The sheet size detecting mechanism 530 is adapted to read data of, among others, user's sheet setting at the printer driver or on the operation panel 340, and detection data of a sheet size sensor at a respective feed tray and on a time of passage at a respective transfer route sensor in the printing machine 100, for acquisition of a size or sizes of the sheet or sheets to be targeted in the associated transfer process, to transmit thus acquired sheet size data to the computational processor 330.

The printer driver is adapted to work, when the printing machine 100 is used as if a network printer, for instance, as an application or middleware executed at a client PC on the network to send a command for execution and print data to the printing machine 100. In this embodiment, the printer driver has a sheet-kind setting interface adapted with particulars for user selection to select a kind of sheet. The sheet quality detecting mechanism 520 as well as the sheet size detecting mechanism 530 is adapted to acquire pieces of information, such as type, thickness, and size of sheet in correspondence to the selection of sheet kind.

(2) Transfer Drive Controller

Referring to a detailed diagram in FIG. 5, the transfer drive controller 350 is configured as a set of modules including controllers 351 to 355 to control transfer actions in the system of transfer routes. They receive data from the computational processor 330, and control drives in respective transfer routes in accordance with the received data.

Referring to FIG. 1, the transfer mute system has various drives including a motor drive for the register roller 240, a motor drive for the intermediate transfer roller 295, a motor drive for the primary feed roller 220, motor drives for the switchback roller 281 and the re-feed roller 282, and motor drives for the sets of feed rollers 290 on upstream branches in the feed route subsystem.

The motor drive for register roller 240 is installed in a section of the circulation route CR, upstream of an image forming unit (as a combination of the head unit 110 and the transfer belt 160), and configured as a drive with paired rollers to register a feeding print sheet 10 for adjustment of a timing to send out the print sheet 10 to the image forming unit.

The motor drive for intermediate transfer roller 295 is installed near the junction 214 for confluence of the feed route subsystem FR1 through which the internal feed trays 130 are each in transfer communication with the register R, and is configured as a drive with paired rollers to catch a feeding print sheet 10 in between for transfer of the print sheet 10 to the junction 214.

The motor drive for primary feed roller 220 is configured as a drive to pick up a print sheet 10 from a stack on the side feed tray 120 exposed outside a side wall of the printing machine 100, for transfer to the junction 214 along the feed route subsystem FR2 that is in transfer communication with the register R.

The motor drives for switchback roller 281 and re-feed roller 282 are each configured as a drive with paired rollers to catch in between a print sheet 10 reversed in the switchback route SR or a print sheet 10 having come up to the feed route subsystem FR3, for transfer or re-feed toward the junction 214.

The motor drives for feed roller sets 290 are each installed in a corresponding branch feed route extending from an internal feed tray 130 to the intermediate transfer roller 295, and configured as a drive with paired rollers to catch a print sheet 10 in between to transfer up to a position for engagement with the intermediate transfer roller 295.

In this embodiment, the drives above are independently controllable by individual controllers 351 to 355 in the transfer drive controller 350, being a register motor driving controller 351, intermediate transfer motor driving controller 352, a primary feed motor driving controller 353, a switchback and re-feed motor driving controller 354, and a local transfer motor driving controller 355.

More specifically, the register motor driving controller 351 is implemented as a module to control e.g. start and stop timings and drive speed of a respective drive action of the register drive 240, and provided with a register motor acceleration controller 351*a* adapted for motor control of a drive starting acceleration and an ending deceleration. The intermediate transfer motor driving controller 352 is implemented as a module to control e.g. start and stop timings and transfer speed of a respective transfer action of the intermediate transfer roller 295, and provided with an intermediate transfer motor acceleration controller 352*a* adapted for motor control of a transfer starting acceleration and an ending deceleration. The primary feed motor driving controller 353 is implemented as a module to control e.g. start and stop timings and feed speed of a respective feed action of the primary feed roller 220, and provided with a primary feed motor acceleration controller 353*a* adapted for motor control of a feed starting acceleration and an ending deceleration.

The switchback and re-feed motor driving controller 354 is implemented as a module to control e.g. start and stop timings and transfer speed of a respective transfer action of each of the switchback roller 281 and the re-feed roller 282, and provided with a switchback and re-feed motor acceleration controller 354*a* adapted for motor control of a transfer starting acceleration and an ending deceleration. The switchback and re-feed motor driving controller 354 is adapted to control a transfer speed, a pause of switchback action, or a feed distance in the switchback route SR, alone or in combination, to thereby adjust an overall interval of time for any switchback action. The local transfer motor driving controller 355 is implemented as a module to control e.g. start and stop timings and transfer speed of transfer action of a respective one of local transfer rollers including transfer rollers 290 on the branch feed routes.

(3) Computational Processor

According to the present embodiment, there is an assist control implemented as an integration of drive actions of drives controlled by the computational processor 330 depending on a set of data including the kind of sheet and transfer conditions at associated transfer routes.

Referring to a detailed diagram in FIG. 6, the computational processor 330 includes, as principal elements, a job data receiver 331, a sheet type acquirer 332, an operation signal acquirer 333, a route information database 334, an assist condition calculator 335, an image processor 336, a scheduler 337, and an assist controller 338.

The job data receiver 331 is implemented as a communication interface for reception of a job data set as a series of print process units, in the form of a module adapted to interface data in a received job data set to the image processor 336 and the scheduler 337. Data is received through an available communication system, which may be a LAN such as an intra-home network or an intra-cooperate network, with the 10BASE-T or the 100BASE-TX Internet inclusive, encompassing a local service loop such as an infrared communication.

The image processor 336 is implemented as an operational processor for a specific digital signal processing addressed to an image processing, in the form of a module adapted for conversion of image data as necessary to execute a printing. The image processor 336 includes an image formation controller 336*a* and a color converter 336*b*. The color converter 336*b* is implemented as circuitry to convert RGB image data into CMYK image data, and the image formation controller 336*a* is configured to control formation of images in accordance with image data of CMYK colors. The image formation controller 336*a* is implemented as a module for driving ink heads of CMYK colors, as well as controlling transfer actions of feeders in the transfer route system, as necessary to control an entire image processing for formation of images at printing speeds and timings according to a schedule managed by the scheduler 337.

The operation signal acquirer 333 is implemented as a module for receiving user operation signals from the operation panel 340, for analyses of received signals to have other modules execute adequate processes in accordance with user operations. In this embodiment, the operation signal acquirer 333 is adapted to accept settings, as well as operations for setups such as sheet setups or instructions by user as to whether or not an execution of assist process is called for, through a communication interface 341 connected to a printer driver, or from the operation panel 340. The operation signal acquirer 333 thus acquires necessary information, of which the necessity of assist control as well as an associated condition set is input to the assist condition calculator 335, and sheet setups are input to the sheet type acquirer 332.

The sheet type acquirer 332 is implemented as a module for receiving, from among information detected at the sheet detection module set 500 or acquired at the operation signal acquirer 333, those pieces of information representing e.g. type, size, and/or thickness of a print sheet 10 to be fed, as a sheet type data set. The sheet type acquirer 332 is adapted to output a set of received sheet type data to the assist condition calculator 335 for a current printing process.

The route information database 334 is implemented as a module for storing transfer condition sets of the transfer route system to output, to the assist condition calculator 335 among others (not all depicted in FIG. 6), a set of necessary data on transfer conditions according to a transfer route or transfer routes selected for a current printing process. Each stored transfer condition set covers length, flexural point number, and/or roller number of an associated transfer route, as well as relationships between transfer time and values of acceleration and deceleration of the register roller 240.

The assist condition calculator 335 is implemented as a module for processing input data on transfer conditions including values of acceleration and deceleration of the register roller 240, in consideration of a current sheet type data set, to calculate a set of assist conditions as necessary to adjust a slack of a current print sheet 10 extending between the register roller 240 and a feeder or feeders in an associated one of the feed route subsystems FR1, FR2, and FR3. In this respect, the assist condition calculator 335 is adapted to collate transfer condition sets of the feed route system FR each stored as a set of inherent transfer conditions of an associated feed route in the route information database 334, to calculate sets of assist conditions of associated routes in accordance with a current sheet type data set acquired at the sheet type acquirer 332.

Each set of assist conditions constitutes a set of control data available for, among others, synchronizing a feed speed or feed acceleration of a respective feeder with performances of the register roller 240 such as start and stop or sudden acceleration and sudden deceleration, as necessary, to adjust relative speeds or accelerations of associated drives. The assist condition calculator 335 is adapted to check a current schedule prepared at the scheduler 337, for collation of programmed feeds as to "which print sheet, at which timing, by which feed route", to read a transfer condition set every print sheet, to calculate an assist condition set every print sheet, to output to the assist controller 338.

The scheduler 337 is implemented as a module for determining an operation sequence, operation timings, transfer speeds or transfer accelerations of drives, as well as a rate or speed of image formation, in accordance with a current job data set, for preparation of a current schedule. There is a schedule thus prepared at the scheduler 337 and input to an image formation controller 336*a* of the image processor 336 as well as to the transfer drive controller 350, where it is referred to for execution of an image formation process as well as for transfer control processes. The schedule prepared at the scheduler 337 is input also to the assist controller 338.

The assist controller 338 is implemented as a module for controlling a transfer speed or transfer acceleration of a respective drive in a set of drives selected in accordance with an assist condition set for each print sheet. More specifically, the assist controller 338 is adapted to work in accordance with a combination of calculation results at the assist condition calculator 335 and a scheduling at the scheduler 337, to provide necessary data for controls to adjust transfer speeds or transfer accelerations of associated drives to a relative speed or acceleration in synchronism with an action of the register roller 240 such as a start or stop or a sudden acceleration or deceleration. The assist controller 338 outputs such control data to the transfer drive controller 350, where they are processed to control drives in the feed route system FR, while collating a set of assist conditions calculated at the assist condition calculator 335, to implement an assist control following a given schedule.

(Transfer Control Method)

Figure 7:
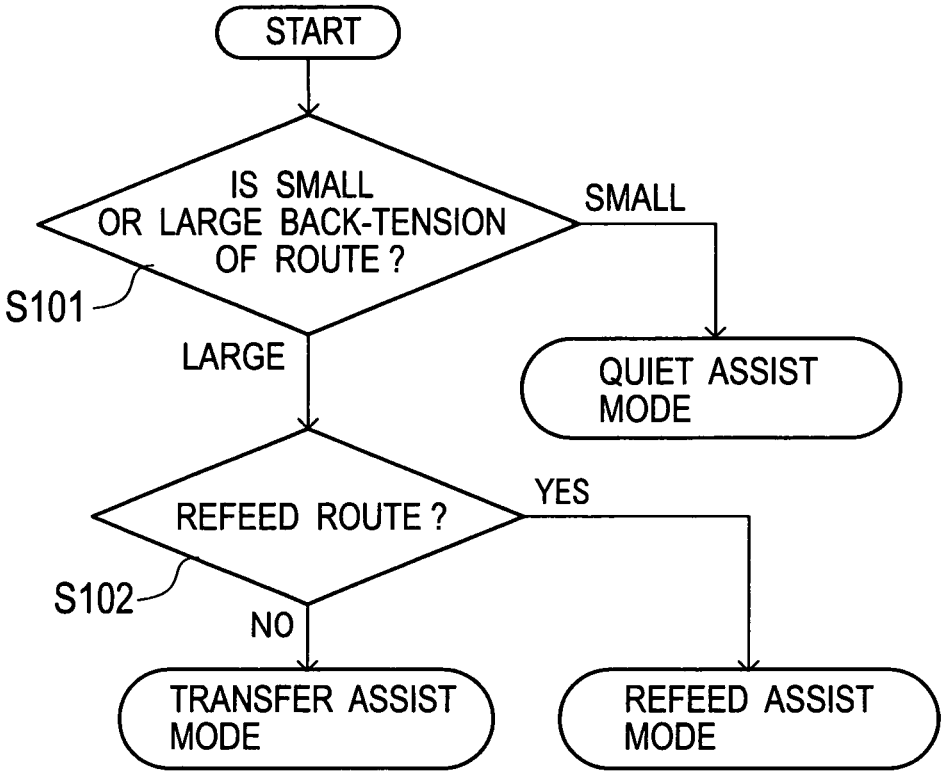
FIG. 7 is a flowchart showing the principle of an assist control according to the embodiment.

The foregoing transfer control system is adapted to implement a transfer control method according to an embodiment of the present invention. FIG. 7 is a flowchart showing the principle of an assist control according to the embodiment.

The assist control is implemented to control drives in the transfer route system, for their adjustments to transfer speeds and/or transfer accelerations that can cooperatively reduce or cancel back tensions that otherwise might have acted on a print sheet 10 in a feed route subsystem FR1, FR2, or FR3, to retain a slack of the print sheet 10 between the register roller 240 and a drive or drives in the feed route subsystem. In this embodiment, the feed route subsystems FR1, FR2, and FR3 are each ranked in terms of a magnitude of back tension estimated from a set of current transfer conditions of a route or routes therein and a current sheet type data, or by a rank-representative data, for use to read or calculate a set of assist conditions of the route or routes corresponding to the rank, for the assist control of associated transfer routes to be performed along with a current printing process in an assist mode according to the assist condition set.

As shown in FIG. 7, at a step S101, there is acquisition of an image data set, such as by reception of a job data set, including information on a print sheet or print sheets to be fed from any feed route subsystem for the printing, for each of which it is determined whether the feed route subsystem is smaller or larger than a reference rank of estimable back tension. If the feed route subsystem is larger in back tension ("LARGE" at the step S101), the control flow goes to a step S102, where it is determined whether or not the route subsystem is the feed route subsystem FR3 for re-feed (or the feed route subsystem FR1). If the subsystem is the feed route subsystem FR3 for re-feed ("Y" at the step S102), the control flow goes to a step for the assist control to be performed in a re-feed assist mode. Or else ("N" at the step S102), the control flow goes to a step for the assist control to be performed in a transfer assist mode. Unless the feed route subsystem is larger in back tension (i.e. "SMALL" at the step S101), the control flow goes to a step for the assist control to be performed in a quiet assist mode.

The assist control is based on the principle of starting drives such as rollers in an associated feed route subsystem FR1, FR2, or FR3 simultaneously with the timing for the register roller 240 to send out a print sheet, and accelerating or decelerating associated drives such as rollers in synchronism with acceleration or deceleration of the register roller 240. Description is now made of respective assist modes of assist control.

(1) Quiet Assist Mode

Figure 8A:
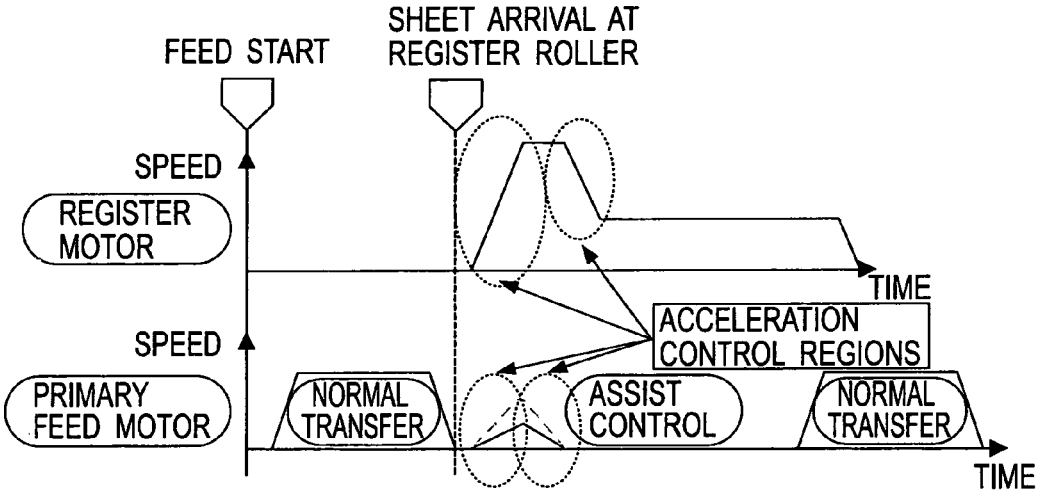
FIG. 8A is a time chart of control in a quiet assist mode according to the embodiment, and FIG. 8B, a time chart of control in a transfer assist mode according to the embodiment.

Referring to FIG. 8A, the quiet assist mode includes: starting accelerating a register motor for the register roller 240, concurrently accelerating a primary feed motor for the primary feed roller 220; starting decelerating the primary feed motor at a timing t11 when a print sheet having been slacked between the register roller 240 and the primary feed roller 220 gets un-slacked in between, or at a timing t12 when the un-slacked print sheet is fed by a prescribed displacement (i.e., at a moment when the register motor enters a constant revolution speed); and afterwards, stopping the primary feed motor no matter how the register motor behaves.

Figure 10:
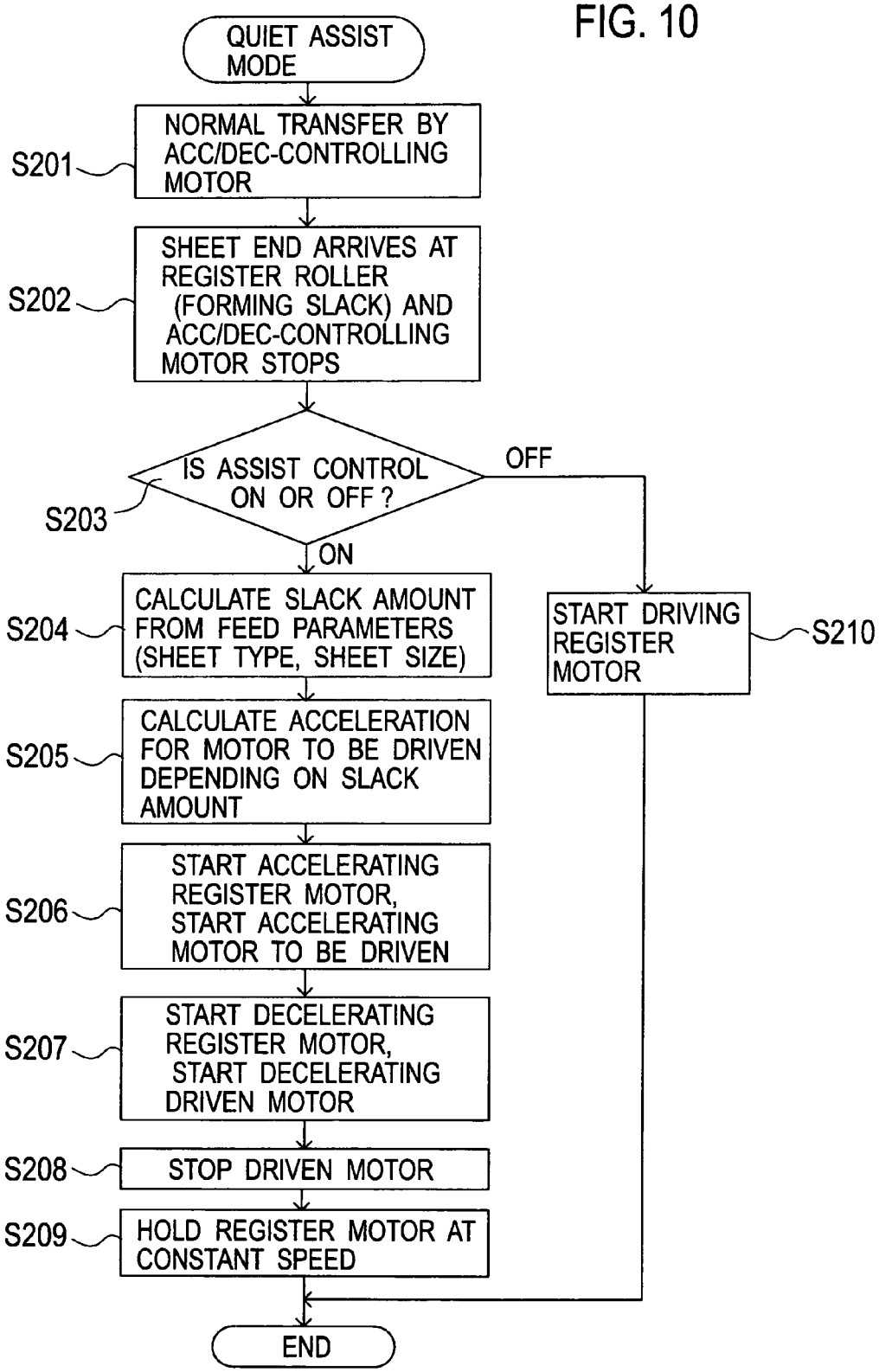
FIG. 10 is a flowchart of control actions in the quiet assist mode.

FIG. 10 shows a flow of control actions in the quiet assist mode. At a step S201, the feed route subsystem FR2 is working for a normal transfer for sheet feed. There is a print sheet picked up and being fed by the primary feed roller 220. In due course, at a step S202, the print sheet has its leading edge engaged with the register roller 240, thus getting slacked, when the transfer drive controller 350 controls associated drive motors to stop.

Then, at a step S203, the operation panel 340 inputs a set of data on user's operation, by use of which it is determined whether or not the instruction for assist control is on or off. If the assist control is off ("OFF" at the step S203), then the control flow goes to a step S210, to directly start the register motor for a current printing process to be free of acceleration control of the drive, there being no assist control before start of a subsequent feed. Unless the assist control is off (i.e. "ON" at the step S203), the control flow goes to a step S204, where the assist condition calculator 335 estimates by calculation a slack of the print sheet in accordance with a sheet type data and a transfer condition set of an associated feed in assistance in a current printing process. At a step S205, the assist condition calculator 335 determines by calculation a set of accelerations of associated drive motors in accordance with the slack.

At a step S206, the register motor acceleration controller 351*a* starts accelerating the register motor, and the primary feed motor acceleration controller 353*a* starts accelerating the primary feed motor in accordance with the estimated slack, at the very drive timing of the register motor. Then, at a step S207, the primary feed motor is decelerated, and at a step S208, the primary feed motor stops. The deceleration to the stop is started at a timing t11 when the print sheet having been slacked between the register roller 240 and the primary feed roller 220 gets un-slacked in between, or at a timing t12 when the un-slacked print sheet is fed by a prescribed displacement (i.e. at a timing of a start of deceleration at the register motor). Such the assist control is completed, at a step S209, where the register motor arrives at a constant revolution speed, and the control flow goes to a start for a subsequent sheet feed.

(2) Transfer Assist Mode

Figure 8B:
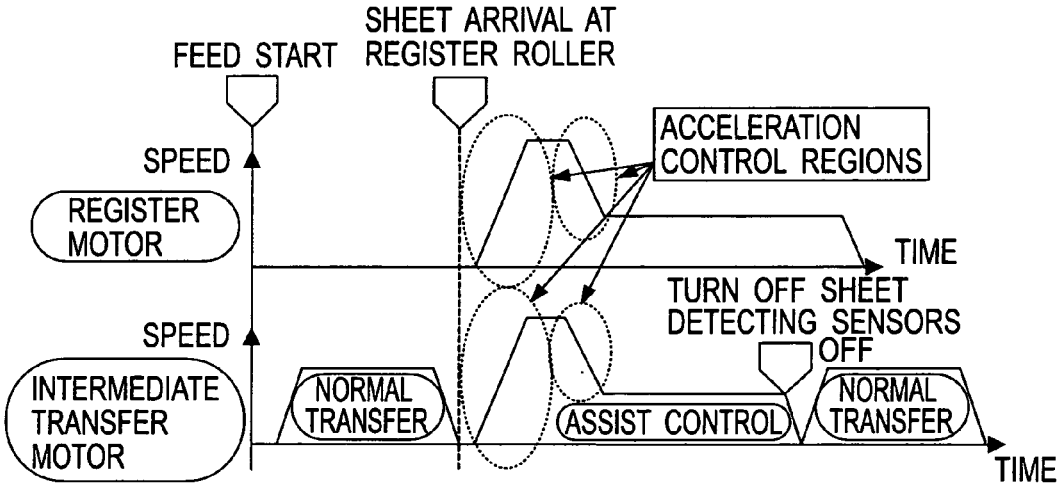

Referring now to FIG. 8B, the afore-mentioned transfer assist mode includes: starting accelerating the register motor at a timing t21, concurrently accelerating an intermediate transfer motor for the intermediate transfer roller 295; accelerating or decelerating the intermediate transfer motor in synchronism with acceleration or deceleration of the register motor, during passage of a print sheet being detected; and stopping the intermediate transfer motor at a timing t22 when the print sheet has passed the intermediate transfer roller 295.

Figure 11:
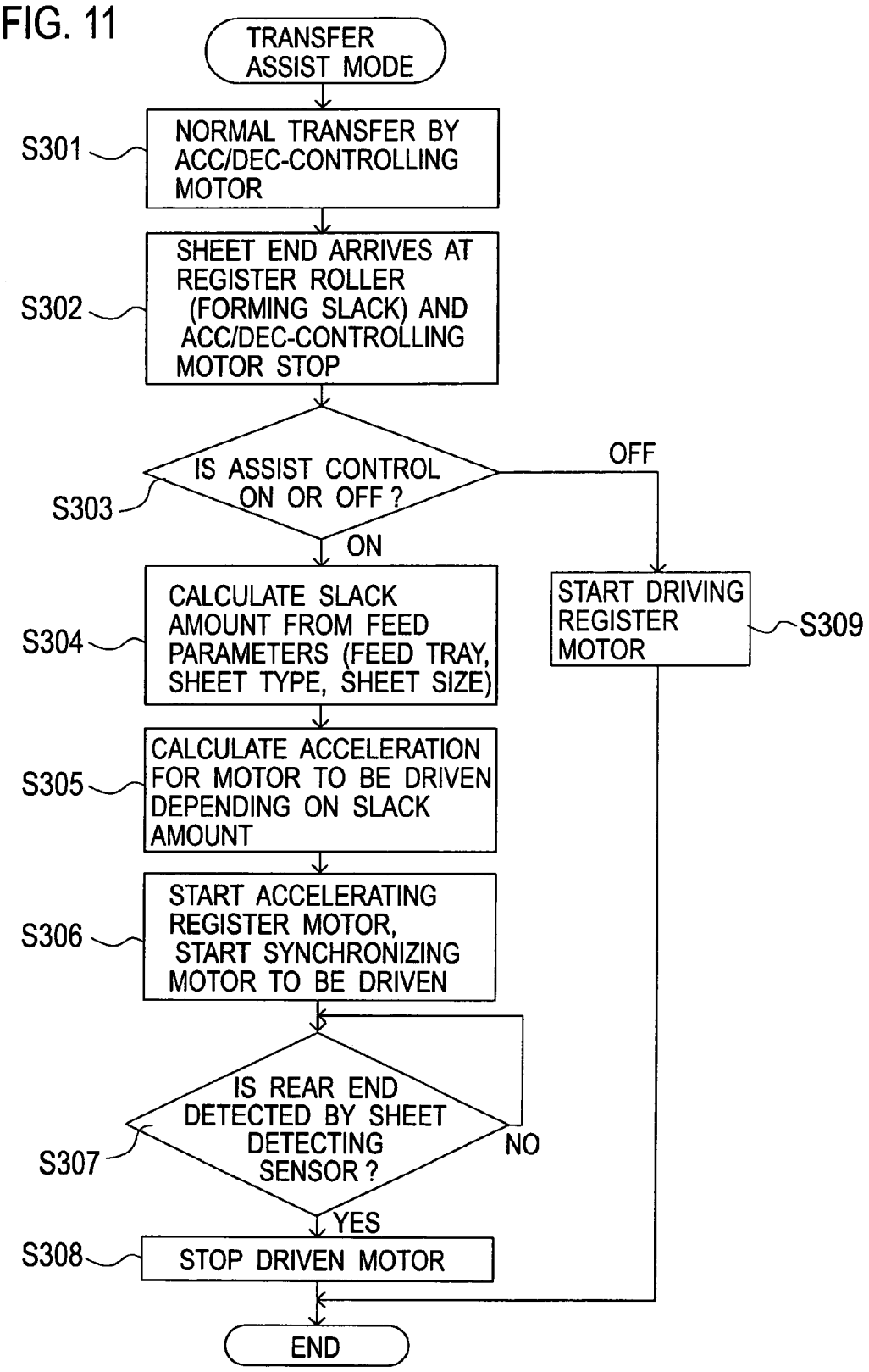
FIG. 11 is a flowchart of control actions in the transfer assist mode.

FIG. 11 shows a flow of control actions in the transfer assist mode. At a step S301, the feed route subsystem FR1 is working for a normal transfer for sheet feed. There is a print sheet being fed by the intermediate transfer roller 295. In due course, at a step S302, the print sheet has its leading edge engaged with the register roller 240, thus getting slacked, when the transfer drive controller 350 controls associated drive motors to stop.

Then, at a step S303, the operation panel 340 inputs a set of data on user's operation, by use of which it is determined whether or not the instruction for assist control is on or off. If the assist control is off ("OFF" at the step S303), then the control flow goes to a step S309, to directly start the register motor for a current printing process to be free of acceleration control of the drive, to transfer the print sheet at an ordinary feed speed or acceleration. Unless the assist control is off (i.e. "ON" at the step S303), the control flow goes to a step S304, where the assist condition calculator 335 estimates by calculation a slack of the print sheet in accordance with a sheet type data and a transfer condition set of an associated feed in assistance in a current printing process. At a step S305, the assist condition calculator 335 determines by calculation a set of accelerations of associated drive motors in accordance with the slack.

At a step S306, the register motor acceleration controller 351*a* starts acceleration control of the register motor, and the intermediate transfer motor acceleration controller 352*a* starts acceleration control of the intermediate transfer motor in accordance with the estimated slack, at the very drive timing of the register motor.

In this assist control, the intermediate transfer roller 295 has an identical transfer speed to the register roller 240, while the register motor has a constant transfer speed, and deceleration of the intermediate transfer motor is started when that of the register motor is started. Then, at a step S307, it is determined whether or not an associated sheet detection sensor 511 has detected a trailing end of the print sheet. If the sheet detection sensor 511 is failing to detect a trailing end of the print sheet ("N" at the step S307), the intermediate transfer motor is to be kept synchronized with the register motor. If the trailing end of the print sheet is detected by sheet detection sensor 511 ("Y" at the step S307), then the control flow goes to a step S308, where the intermediate transfer roller 295 is stopped, to complete the assist control, and the control flow goes to a start for a subsequent sheet feed.

(3) Re-Feed Assist Mode

Figure 9A:
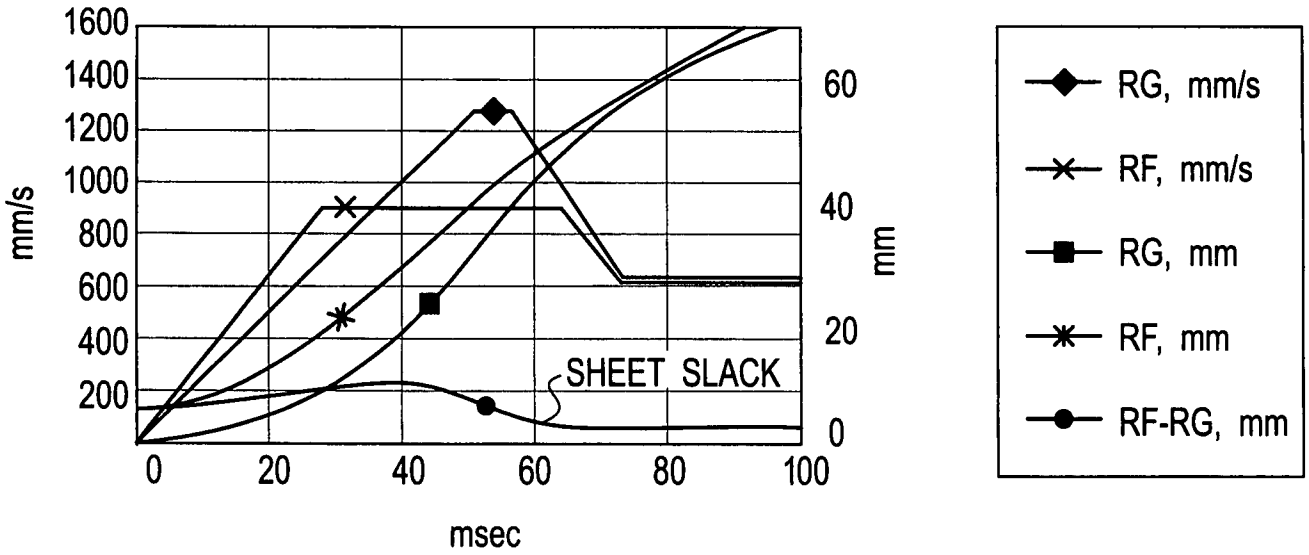
FIG. 9A is a time chart of control in a re-feed assist mode according to the embodiment, and FIG. 9B, a time chart for description of the re-feed assist mode.
Figure 9B:
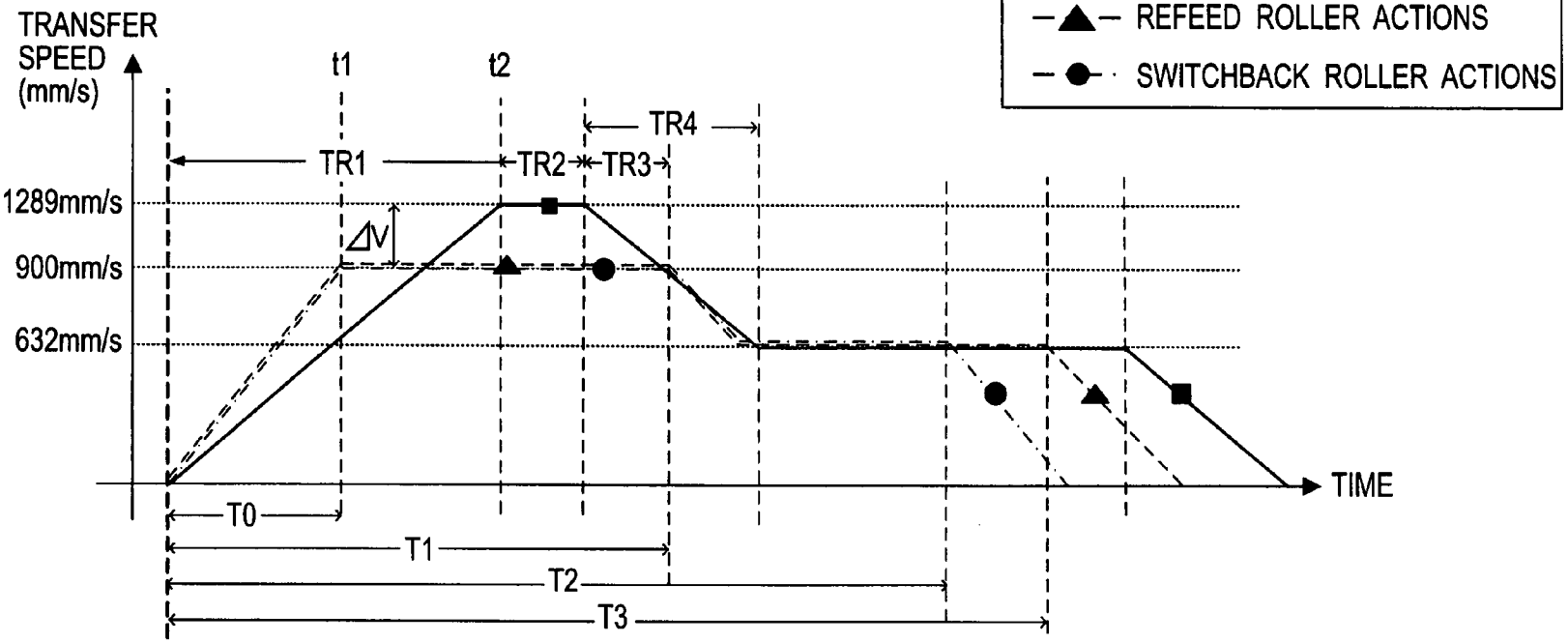

Referring to FIG. 9A and FIG. 9B, the afore-mentioned re-feed assist mode includes: starting accelerating the register motor at a time t0, concurrently accelerating a re-feed motor for the re-feed roller 282; accelerating or decelerating the re-feed motor in synchronism with the register motor, during passage of a print sheet being detected; and sequentially decelerating (to stop) a switchback motor for the switchback roller 281 and the re-feed motor, at times T2 and T3 when the print sheet has passed the switchback roller 281 and the re-feed roller 282, respectively.

Figure 12:
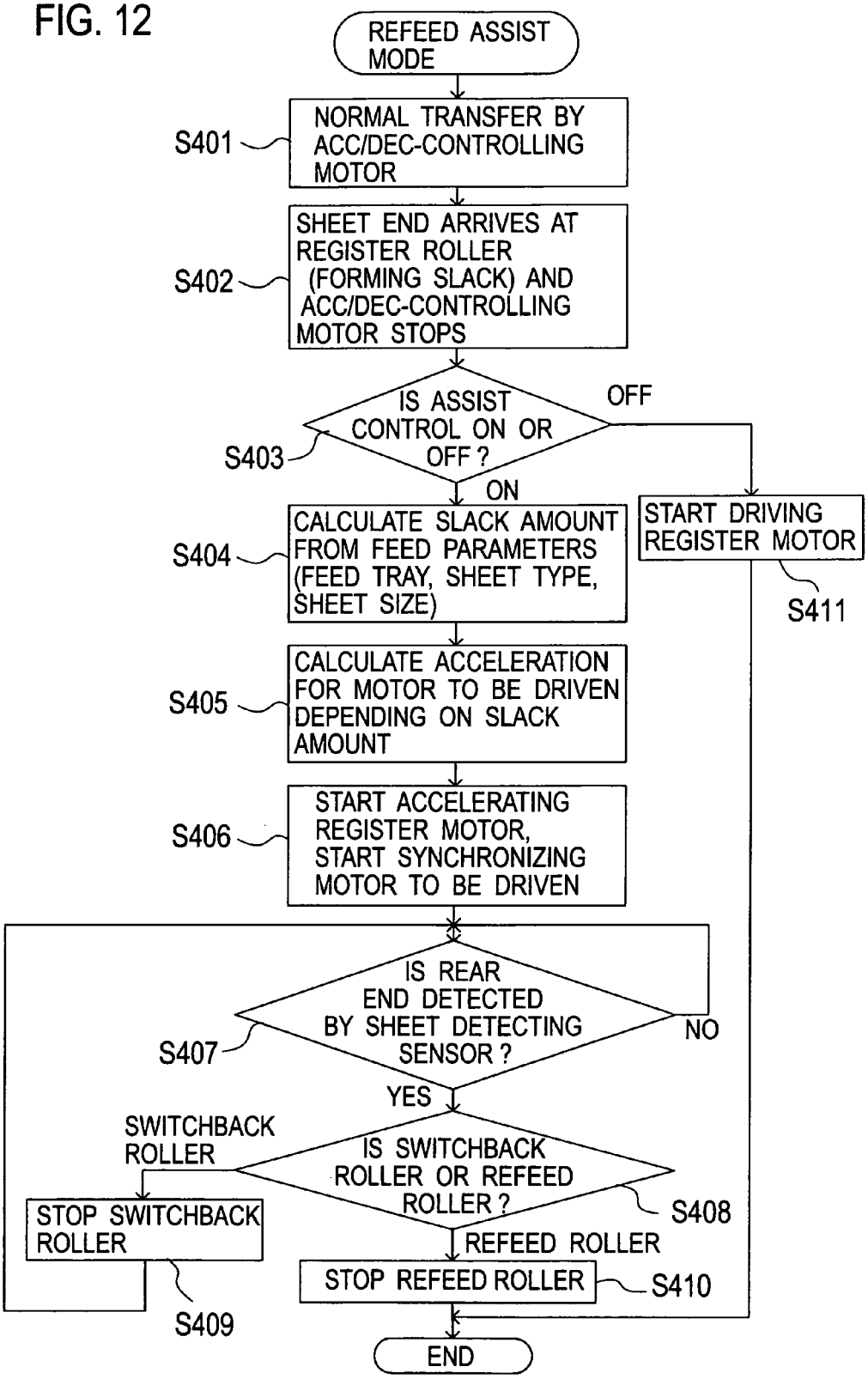
FIG. 12 is a flowchart of control actions in the re-feed assist mode.

FIG. 12 shows a flow of control actions in the re-feed assist mode. At a step S401, the feed route subsystem FR3 as well as the switchback route SR is ready for a normal transfer for sheet feed. There is a print sheet switched back by the switchback roller 281 and reversed in the switchback route SR and being fed to the feed route subsystem FR3. In due course, at a step S402, the print sheet has its leading edge engaged with the register roller 240, thus getting slacked, when the transfer drive controller 350 controls associated drive motors to stop.

Then, at a step S403, the operation panel 340 inputs a set of data on user's operation, by use of which it is determined whether or not the instruction for assist control is on or off. If the assist control is off ("OFF" at the step S403), then the control flow goes to a step S411, to directly start the register motor for a current printing process to be free of acceleration control of the drives, to transfer the print sheet at an ordinary feed speed or acceleration. Unless the assist control is off (i.e. "ON" at the step S403), the control flow goes to a step S404, where the assist condition calculator 335 estimates by calculation a slack of the print sheet in accordance with a sheet type data and a transfer condition set of an associated feed in assistance in a current printing process. At a step S405, the assist condition calculator 335 determines by calculation a set of accelerations of associated drive motors in accordance with the slack.

At a step S406, the register motor acceleration controller 351*a* starts acceleration control of the register motor, and the switchback and re-feed motor acceleration controller 354*a* starts acceleration control of the switchback motor and the re-feed motor in accordance with the estimated slack, at the very drive timing of the register motor. In this assist control, the switchback roller 281 as well as the re-feed roller 282 has a constant transfer speed at a time t1 (cf. FIG. 9B), before a time t2 when the register roller 240 reaches its constant transfer speed.

More specifically, as shown in FIG. 9, the register roller 240 reaches the constant transfer speed at the time t2 following a preceding period T0, where for a slack (to be retained) not to be lost the switchback roller 281 and the re-feed roller 282 have been driven at greater accelerations than the register roller 240. Past the period T0, during a period from the time t1 to the time t2, the switchback roller 281 and the re-feed roller 282 have a constant transfer speed. They are held at the constant transfer speed during this period, where the register roller 240 is driven at an increasing transfer speed till it has a speed difference ΔV relative to the switchback roller 281 and the re-feed roller 282, causing the print sheet to un-slack, as shown in FIG. 9A.

Next, the transfer drive controller 350 starts decelerating the register motor, and after lapse of a preset interval of time, starts decelerating the switchback motor and the re-feed motor. In this embodiment, the register roller 240 being decelerated has a transfer speed equal to the constant transfer speed of the switchback roller 281 and the re-feed roller 282, when these rollers 281 and 282 instantaneously start being decelerated. This start of deceleration is designated by a time T1 in FIG. 9B. Letting now: TR1 be an acceleration period of the register roller 240; TR2 be a constant speed period of the roller 240; TR3 be a period from the start of deceleration of the roller 240 to that of the rollers 281 and 282; TR4 be a deceleration period of the roller 240; and Tbr be a total period from the start of acceleration to an end of the deceleration of the roller 240, the transfer drive controller 350 is adapted to provide relationships in between, such that:

$$T1=TR1+TR2+TR3, \text{ and}$$

$$TR2=Tbr-(TR1+TR4).$$

In other words, in the time chart of FIG. 9B, the register roller 240 starts raising its transfer speed at the time t0 (as an assist start time designated by a vertical broken bold line in the figure), when a print sheet 10 that has been slacken till then between the register roller 240 and the re-feed roller 282 is pushed forth to start a travel in a belt platen direction (along the circulation route CR). There is a leading edge of the print sheet 10 traveling past the register roller 240, which immediately arrives at the transfer belt 160 and starts following a constant-speed movement of the transfer belt 160 at the time t2, when the register roller 240 enters a period TR2, where it has a constant transfer speed. Accordingly, TR1+TR2+TR4=Tbr, which gives the expression TR2=Tbr−(TR1+TR4).

Afterward, at a step S407, it is checked whether no trailing end of the print sheet 10 is yet detected (as a sheet detection is continued) or not at the sheet sensor 514 (on SR) and the sheet sensor 513 (on FR3). If such the trailing end detection is yet absent ("N" at the step S407), the switchback roller 281 and the re-feed roller 282 are kept synchronized with the register roller 240 until the detection is made. If either the sheet sensor 514 or the sheet sensor 513 detects a trailing end of the print sheet 10 ("Y" at the step S407), then the control flow goes to a step S408 to determine whether the detection is made by the sheet sensor 514 upstream of the switchback roller 281 or by the sheet sensor 513 downstream of the re-feed roller 282. If it is by the sensor 514 ("SWITCHBACK ROLLER" at the step S408), then the flow goes to a step S409, where the switchback roller 281 is stopped. If it is by the sensor 513 ("REFEED ROLLER" at the step S408), then the flow goes to a step S410, where the re-feed roller 282 is stopped. As the print sheet 10 has passed the switchback roller 281 and the re-feed roller 282 in this order, the current assist control is completed with the passage at the re-feed roller 282, before s subsequent sheet feed.

It is noted that the switchback roller 281 is decelerated to stop at the time T2 in FIG. 9B. Referring now to FIG. 2B, the circulation route CR has the re-feed roller 281 at a route distance Lss from the switchback roller 281, and the register roller 240 at a route distance Lsr from the re-feed roller 281. Accordingly, at the time T2 above, the print sheet 10 is fed by a route distance L2, estimable such that $$L2=(\text{sheet length})-(Lss+Lsr).$$

There occurs a pause for print sheets longer than (Lss+Lsr+slack). In this connection, the re-feed roller 282 is decelerated to stop at the time T3 in FIG. 9B. At this time T3, the print sheet 10 is fed by a route distance L3, estimable such that $$L3=(\text{sheet length})-Lsr.$$

Such being the case, according to the present embodiment, there is acquisition of a set of pieces of information on acceleration and deceleration of a register roller corresponding to characteristics of subsystems of a feed route system, for use to control a transfer speed as well as a transfer acceleration of any associated feeder in consideration of a slack of a print sheet between the feeder and the register roller, thereby permitting cancellation of probable back tensions on the print sheet, allowing for reduced noises upon un-slacking. In this embodiment, the feeder is assist-controlled in accordance with an inherent transfer condition set of any feed route subsystem, including a feed route length, a feed route flexion number, and/or a roller number, allowing for an adequate back-tension elimination.

Further, according to the present embodiment, there is selection of an adequate assist mode in accordance with a sheet type data set including a type, size, and/or thickness of a print sheet to be fed, permitting a stable slacking of the print sheet, allowing for a secured noise reduction, as well as an adequate back-tension elimination.

In addition, according to the present embodiment, there is adoption of a scheduling to insert a print sheet reversed by circulation through a switchback route between print sheets to be printed on the front sides, for a parallel processing of front-side printing and back-side printing to afford an enhanced print-productivity in a duplex printing, permitting cancellation of back tensions in a complicate re-feed mute, allowing for eliminated noises upon un-slacking of print sheet.

While the preferred embodiments of the present invention have been described using specified terms, such description is for illustrative purposes, and it is to be understood that changes and variations may be made without departing from the spirit or scope of the following claims.

This application is based upon the Japanese Patent Applications of Application Nos. 2009-066362, 2009-066445, and 2009-066480, filed on Mar. 18, 2009, the entire contents of which are incorporated herein by reference.

What is claimed is:

1. A printing machine comprising:

an image forming unit adapted for formation of images on a recording medium in course of transfer on a transfer route;

a register installed upstream of the image forming unit on the transfer route and adapted for adjustment of a timing to send a recording medium to the image forming unit;

a feeder set adapted for feed of a recording medium to the register;

a feed route system adapted for connection of feed route through the feeder set to the register; and an assist controller configured to change an acceleration of the feeder set in synchronization with the register in accordance with information on a tension of a recording medium in the feed route system, wherein the assist controller comprises:

a route information database configured to store therein a transfer condition set of the feed route system; and an assist condition calculator configured for acquisition of information on acceleration and deceleration of the register and collation thereof with transfer conditions stored in the route information database, to calculate as an assist condition a slack of a recording medium between the register and a feeder, wherein the assist controller is configured to change an acceleration of the feeder in accordance with the assist condition; and wherein the feed route system comprises:

a system of routes each configured for transfer of recording medium to the register; and feeders each configured for feed of recording medium along a corresponding transfer route to the register, and the assist condition calculator is adapted to calculate an assist condition of a respective one of the routes in accordance with transfer conditions thereof, and the assist controller is configured to change an acceleration of a corresponding feeder in accordance with the assist condition, and wherein the system of feed routes includes a re-feed route configured to feed a recording medium to the register from a switchback route branched from the transfer route for a reverse of recording medium.

2. The printing machine according to claim 1, further comprising scheduler configured to determine a transfer schedule of recording medium, wherein the assist controller is adapted for estimation of a tensile force of recording medium in the re-feed route in accordance with the transfer schedule, to change an acceleration of a feeder in the re-feed route in dependence on the estimation.

3. A printing machine, comprising:

an image forming unit adapted for formation of images on a recording medium in course of transfer on a transfer route;

a register installed upstream of the image forming unit on the transfer route and adapted for adjustment of a timing to send a recording medium to the image forming unit;

a feeder set adapted for feed of a recording medium to the register;

a feed route system adapted for connection of feed route through the feeder set to the register; and an assist controller configured to change an acceleration of the feeder set in synchronization with the register in accordance with information on a tension of a recording medium in the feed route system, wherein the assist controller comprises:

a route information database configured to store therein a transfer condition set of the feed route system; and an assist condition calculator configured for acquisition of information on acceleration and deceleration of the register and collation thereof with transfer conditions stored in the route information database, to calculate as an assist condition a slack of a recording medium between the register and a feeder, wherein the assist controller is configured to change an acceleration of the feeder in accordance with the assist condition, wherein the transfer condition includes at least one of a length of a route of the feed route system, a flexion number of the route of the feed route system, and a roller number of the route of the feed route system.

4. The printing machine according to claim 3, wherein the feed route system comprises:

a system of routes each configured for transfer of recording medium to the register; and feeders each configured for feed of recording medium along a corresponding transfer route to the register, the assist condition calculator is adapted to calculate an assist condition of a respective one of the routes in accordance with transfer conditions thereof, and the assist controller is configured to change an acceleration of a corresponding feeder in accordance with the assist condition.

5. The printing machine according to claim 4, further comprising a sheet type data acquirer configured to acquire a type, size, and a thickness of recording medium as a sheet type data set, wherein the assist condition calculator is adapted to calculate an assist condition of a respective one of the routes in accordance with transfer conditions thereof and the sheet type data set acquired at the sheet type data acquirer, and the assist controller is configured to change an acceleration of a corresponding feeder in accordance with the assist condition.

* * * * *